US005665304A

United States Patent [19]

Heinen et al.

[11] Patent Number: 5,665,304

[45] Date of Patent: Sep. 9, 1997

[54] DISPLAY UNIT

[75] Inventors: Thomas Heinen, Solingen; Christian Engel, Bad Schwartau, both of Germany

[73] Assignee: Warner-Lambert Company, Morris Plains, N.J.

[21] Appl. No.: 570,920

[22] Filed: Dec. 12, 1995

[51] Int. Cl.[6] ..... A47F 3/02

[52] U.S. Cl. ..... 312/71; 312/114; 211/59.3; 108/110; 292/80

[58] Field of Search ..... 312/71, 61, 114, 312/263; 211/59.3, 94; 292/80, 19; 108/110

[56] References Cited

U.S. PATENT DOCUMENTS

| | | | |
|---|---|---|---|
| 4,349,113 | 9/1982 | Schreiner | 211/88 X |
| 4,706,821 | 11/1987 | Kohls et al. | 312/114 X |
| 4,730,741 | 3/1988 | Jackle, III et al. | 312/71 X |
| 4,762,236 | 8/1988 | Jackle, III et al. | 211/59.3 |
| 4,887,737 | 12/1989 | Adenau | 312/71 X |
| 5,012,936 | 5/1991 | Crum | 312/71 X |
| 5,111,942 | 5/1992 | Bernardin | 312/61 X |
| 5,240,126 | 8/1993 | Foster et al. | 312/71 X |
| 5,450,969 | 9/1995 | Johnson et al. | 211/59.3 |
| 5,542,552 | 8/1996 | Yablans et al. | 211/59.3 |
| 5,562,217 | 10/1996 | Salveson et al. | 312/71 X |

*Primary Examiner*—Peter M. Cuomo
*Assistant Examiner*—Hanh V. Tran
*Attorney, Agent, or Firm*—Charles W. Almer

[57] ABSTRACT

A rack unit display system is provided to display goods, such as in a retail store, in a well structured and ordered manner. The goods are horizontally stacked in the rack unit. A theft protection member is provided which limits unauthorized access to the goods. The left protection member is adjustable in height to allow the display unit to accommodate different sized goods. The goods are pushed forward in the unit by a slide member where the units can then be removed from the rack in small quantities. The back unit is releasably mounted and secured by a lock mechanism on a base member, which in turn is mounted on a rectangular bar. The rack unit can be released from the base member by means of a key. The slide member can be locked in a rear end position of the display unit when the rack unit is removed from the base member. The unit can be filled or refilled with ease without interference from the slide member. The height of the theft protection member is also adjustable. When the rack unit is mounted on the base member, the slide member is automatically released, thereby pushing goods forward.

15 Claims, 8 Drawing Sheets

7
71
74b
72b
73b
74a
73a
72a
32
II
III
34
33
31
35
3
5
39
36
37
38
22
11
12
14
15
21
16
17
19
B
1
20
92
93
91
9

(III-III)

(IV - IV)

DETAIL (V)

DETAIL (VI)

DISPLAY UNIT

TECHNICAL FIELD

This invention relates to a display unit, as is used to display goods for customers and to allow customers to take goods in small quantities out of said display unit.

BACKGROUND ART

It is desirable to present goods in a well-structured and organized manner. A constant appearance can be achieved by pushing goods forward to the front of the display unit either by their own weight or by a spring-loaded slide member.

Display units with this feature have been known for some time; however, it is very tedious to (re)-fill this type of display unit against the force of the spring-loaded slide member or the weight force of the goods. The difficulty is increased when the display unit is mounted on a shelf, where the access to the base is limited.

In order to prevent theft, the display unit should be mounted rigidly, e.g., on a shelf or a counter top; moreover, it should be excluded that an unusually large quantity of goods is removed from the display unit in a single access to the display unit.

This has been achieved previously by leaving only a small opening in a display unit, thereby allowing removal of only one item of the displayed goods at a given time. While this is an adequate solution for the problem of theft, it limits the flexibility of the display unit, i.e., only one size of goods can be displayed with such display units.

It is therefore an object of the present invention to provide a display unit which overcomes the problems mentioned above.

DISCLOSURE OF THE INVENTION

This object is solved by the display unit of independent claim 1. Further advantageous aspects and features are evident from the dependent claims, the description and the drawings.

It is one aspect of the invention to provide a display unit which displays goods in a well-structured and organized manner and which is easy to (re)-fill. This is achieved by a display unit which comprises a base member and a rack unit. Said base member is mounted, for example, on a rectangular bar, and said rack unit is releasably mounted on said base member to display the goods which are stacked in said rack unit. When the rack unit is mounted on said base member, the goods are pushed forward to the front of said rack unit by a slide member.

In a further aspect of the invention, a theft protection is provided which limits the access to the goods in the rack unit to the goods in the rack unit to the extent that only a small number of goods can be removed from the rack unit at a given time. This theft protection is adjustable in height, thereby being able to accommodate goods of different sizes. The height of the theft protection is fixed when the rack unit is mounted on the base member and it can be adjusted in height only when the rack unit is removed from the base member.

In a still further aspect of the invention, the rack unit is locked on said base member, thereby preventing unauthorized removal of the rack unit in its entirety. However, the rack unit can be removed quickly by means of a key which disengages the lock means and, at the same, pushes the rack unit up and out of said base member.

In a still further aspect of the invention, a display unit is provided, wherein the slide member can be locked in a rear position when the rack unit is removed from said base member. In this condition, the rack unit is easily (re-)filled without interference of said slide member; when the rack unit is mounted on the base member, the slide member is automatically released and begins to push the stacked goods forward in the rack unit.

In yet a further aspect of the invention, a tray is provided to be mounted on said base member, instead of said rack unit, if bulk goods have to be displayed.

DETAILED DESCRIPTION OF THE INVENTION

Figure 1A:
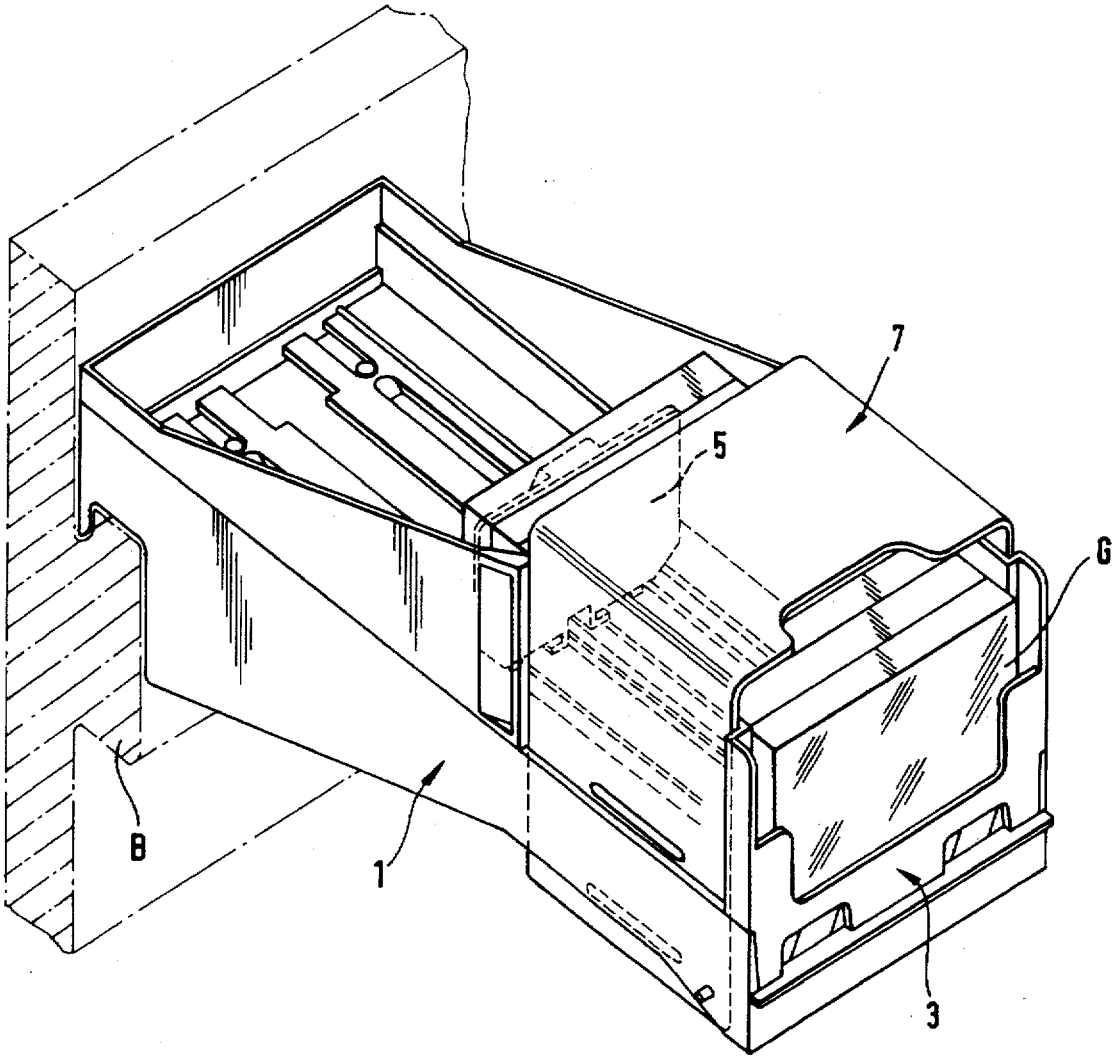
FIG. 1*a* shows the assembled display unit mounted on a rectangular bar and filled with goods.

FIG. 1*a* shows a preferred embodiment of the display unit in operating condition. The goods (G) are horizontally stacked in the rack unit (3) where they are pushed forward by a slide member (5). The front portion of the display unit is covered by the theft protection member (7) which limits the access to the front part of said display unit, from where a small number of goods can be removed at a given time.

The rack unit is mounted on a base member (1) and the whole display unit is mounted on a rectangular bar (B).

Figure 1B:
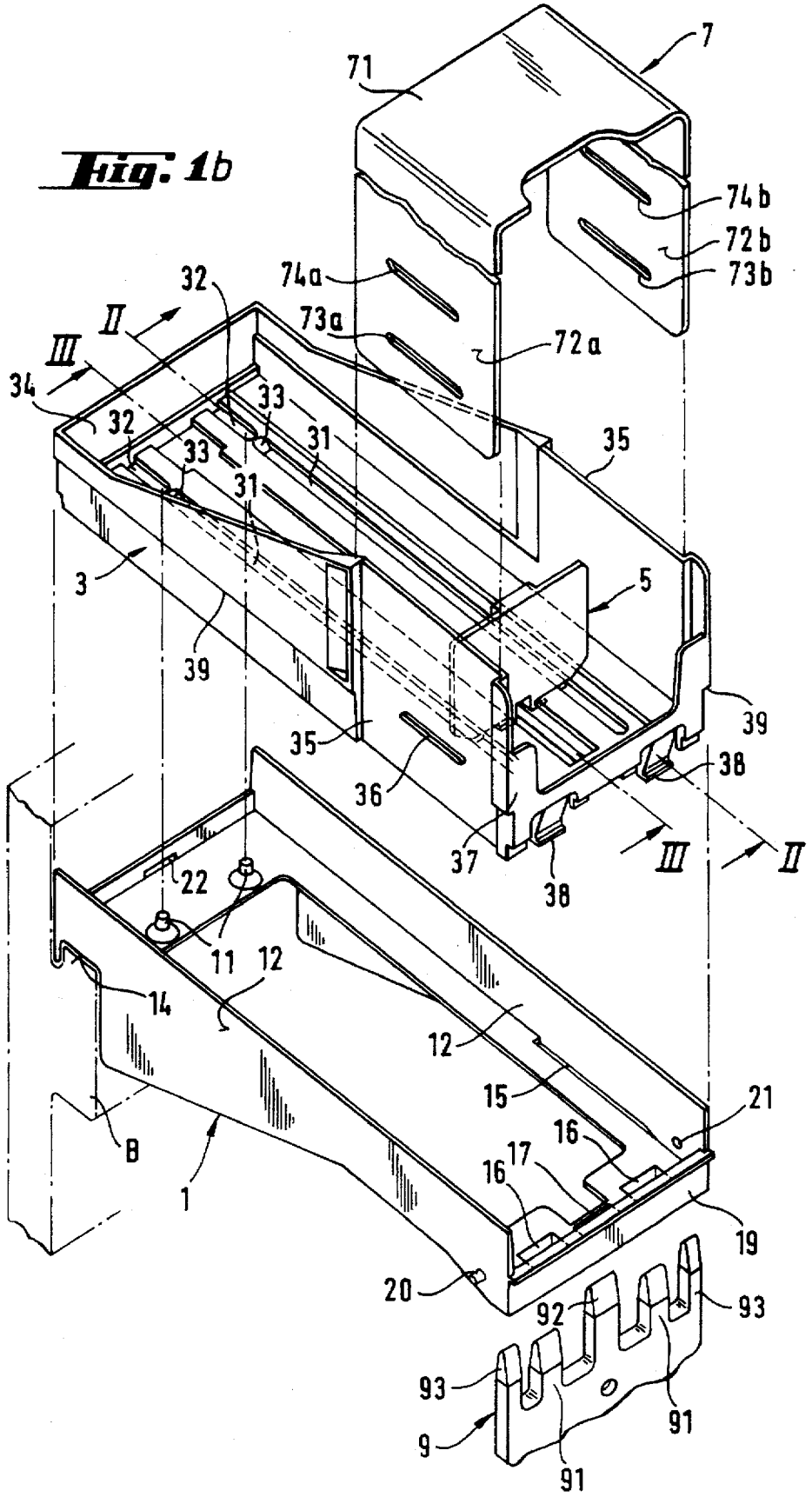
FIG. 1*b* is an enlarged perspective view of the display unit mounted on a rectangular bar.

FIG. 1*b* shows an enlarged perspective view of the preferred embodiment of the display unit, wherein it can be seen how the individual components of the display unit cooperate.

The base member (3) is mounted on the rectangular bar (B) by means of a groove (14).

When the rack unit (3) is mounted on base member (1), the projections (39) of the side walls of said rack unit (3) rest on top of the side walls (12) of said base member (1).

The rack unit (3) is locked on said base member (1) by means of a tongue (40) (not shown), which engages with the slit (22) at the rear end of said base member (1) and by means of the pawls (38), which engage with matching grooves (16) at the front end of the base member.

The theft protection (7) is placed with the side portions (72) in the guiding grooves (35), wherein the upper or lower slits (73, 74) engage with the projections (36), thereby fixing the height of the theft protection member. The lower portions of the side portions (72) of said theft protection member extend through slits (15) through the base plate (22) of said base member (1). The slide member (5) moves forward in the track (41).

Base member (1) preferably has a pin (20) on one side wall and a hole (21) on the other side wall positioned so that in the case where two or more base members are used the pin and hole engage their respective counterparts in the adjacent base member.

Figure 2:
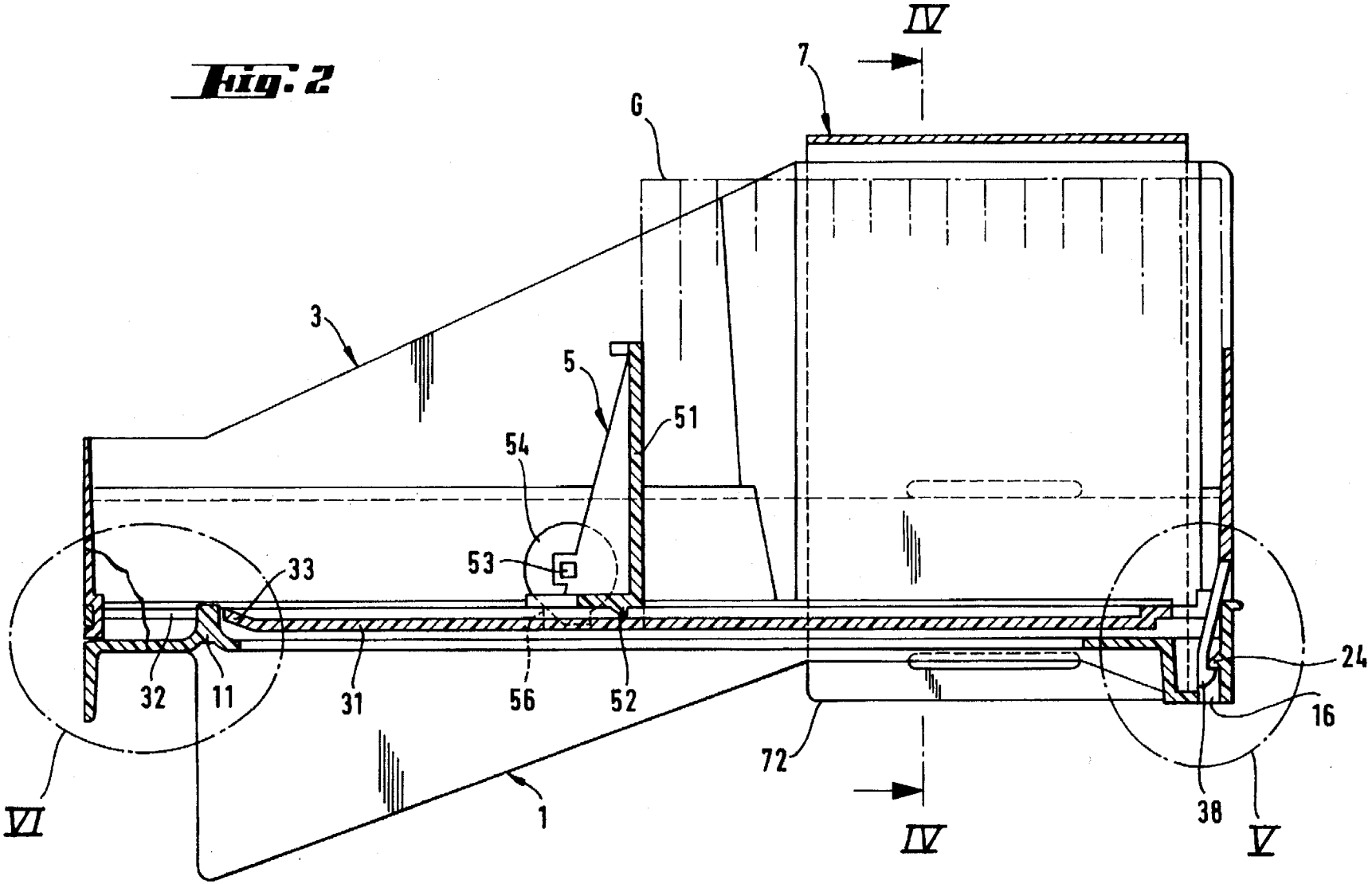
FIG. 2 is a sectional view along the line II—II of the display unit.

FIG. 2 shows a sectional view along the line II—II of FIG. 1*b*. It is shown how the slide member (5) is pulled forward by a spiral spring (54) which is mounted with its axis on the slide member (5). The loose end of said spring (54) is secured at the front end of the rack unit (3).

The front plate (51) of slide member (5) pushes against the rear end of the stack of goods (G), thereby pushing the stack forward if an item is removed at the front end. The downward projection (52) of said slide member (5) glides in the groove (31) of the rack unit (3). In this figure, the theft protection member (7) is placed in a low position.

The two locks (III, IV) will be discussed in detail with FIGS. 4 and 5.

Figure 3:
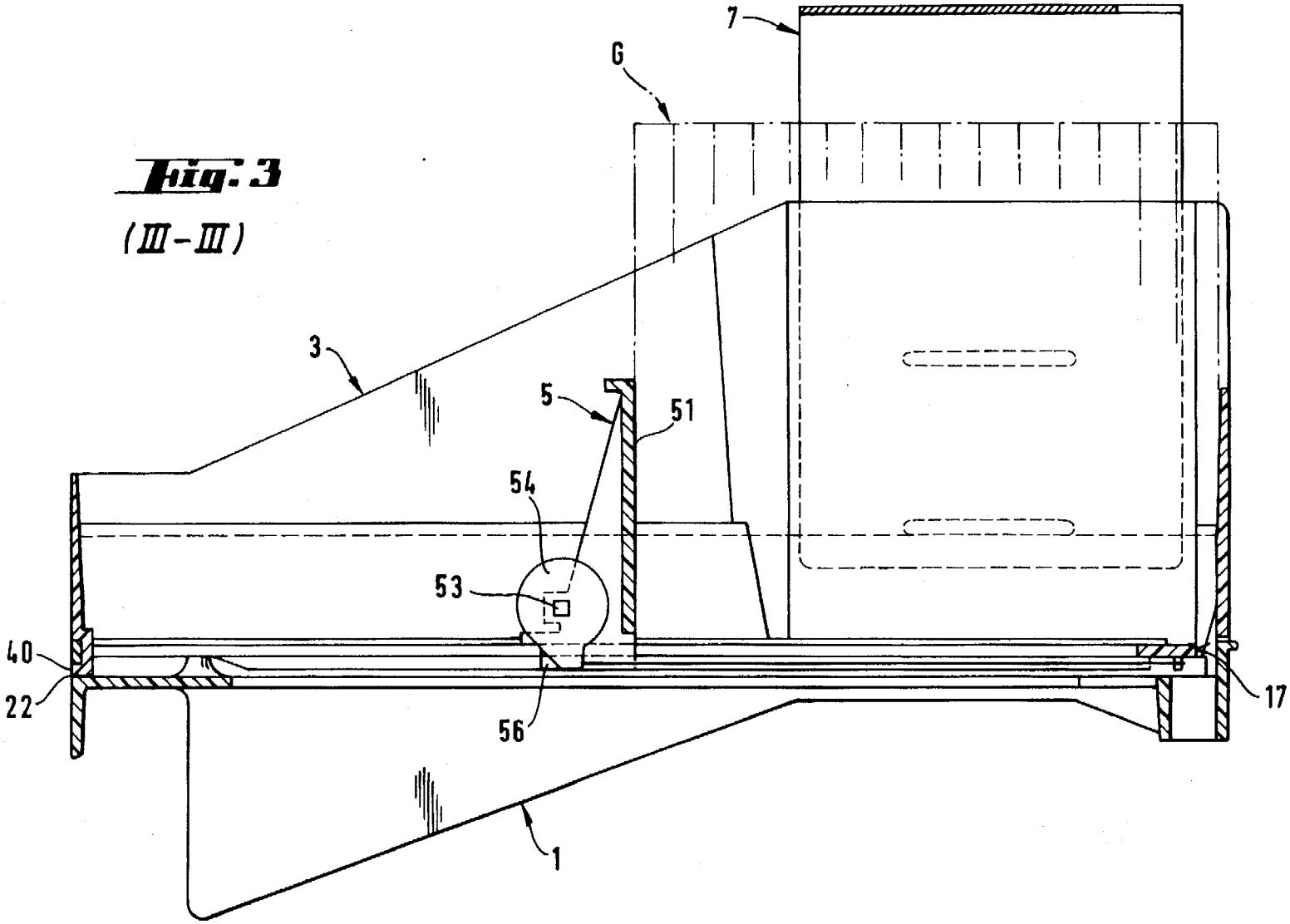
FIG. 3 is a sectional view along the line III—III in the center of the display unit.

FIG. 3 is a sectional view of the display unit along the line III—III, i.e. the center of the display unit. In this figure, the theft protection member (7) is located in a higher position and the rack unit (3) is filled with larger goods (G). In the front portion of the base member (1) an opening (17) is visible. The pushing finger (92) of the key (9) pushes against the bottom of the rack unit (3) through that hole when the rack unit (3) is removed from said base member by means of said key (9).

Figure 4:
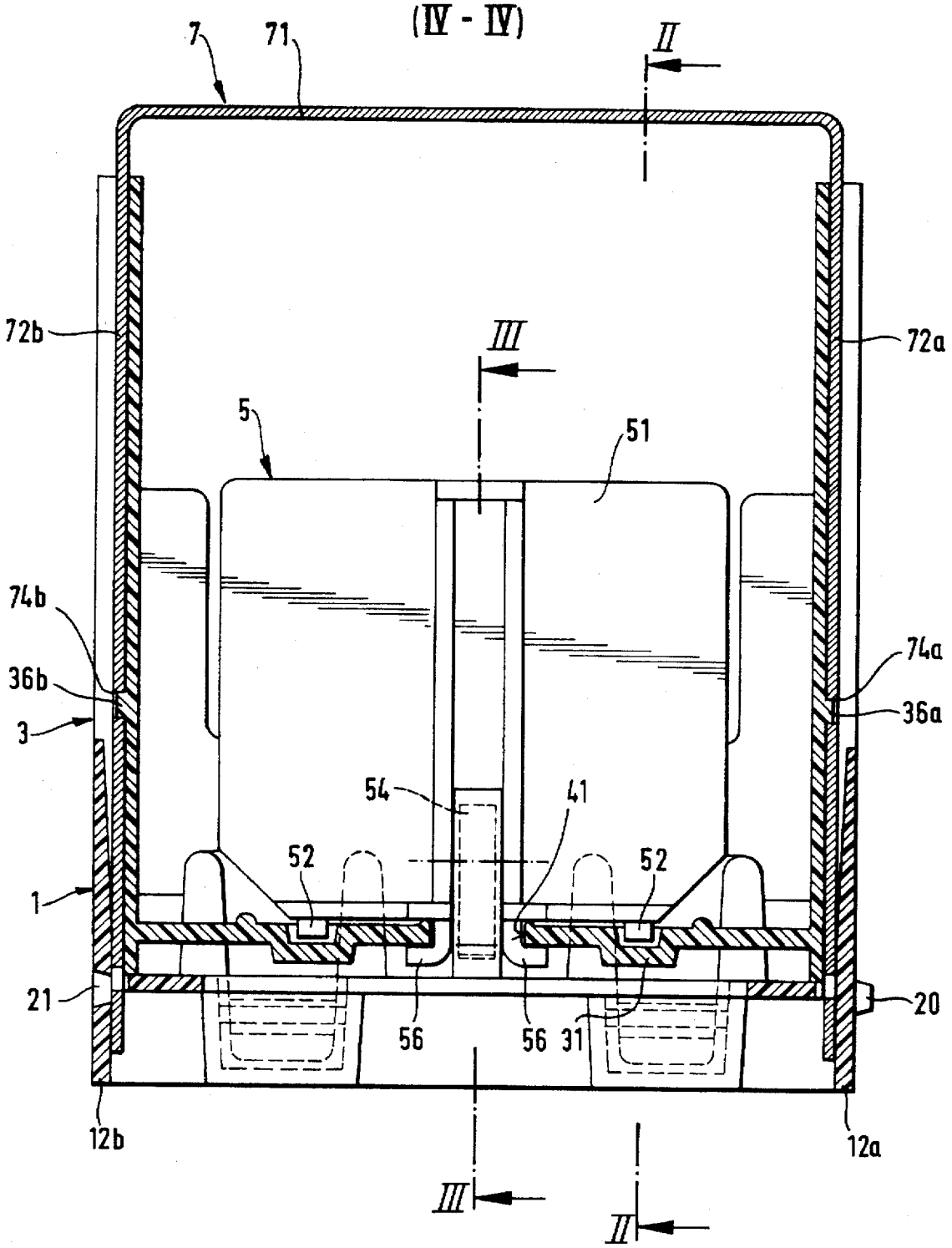
FIG. 4 is a sectional view along the line IV—IV of the display unit.

FIG. 4 is a sectional view along the line IV—IV. The figure shows the slide member (5) with two downward projections (52) gliding in grooves (31). The slide member (5) is held on the track (41) by means of an anchor (56).

In this figure, the theft protection member (7) is located in the lower position. The horizontal grooves (74) in the side portions (72) of said theft protection member engage the projections (36) on the surfaces of said guiding grooves (35), thereby fixing the height of said theft protection member (7).

To vary the height, the side portions (72) have to be bent apart, whereby the grooves (74) are disengaged from said projections (36). Thereafter, the theft protection member can be moved up until the next grooves (73) engage with said projections (35).

However, this is impossible in the configuration shown in FIG. 4, when the rack unit (3) is mounted on said base member (1), because the side walls (12) of that base member confine said side portions (72) of said theft protection member, thereby preventing said side portions from being bent apart.

Consequently, the height of said theft protection member (1) can be adjusted only when the rack unit (3) is removed from said base member (1).

Figure 5:
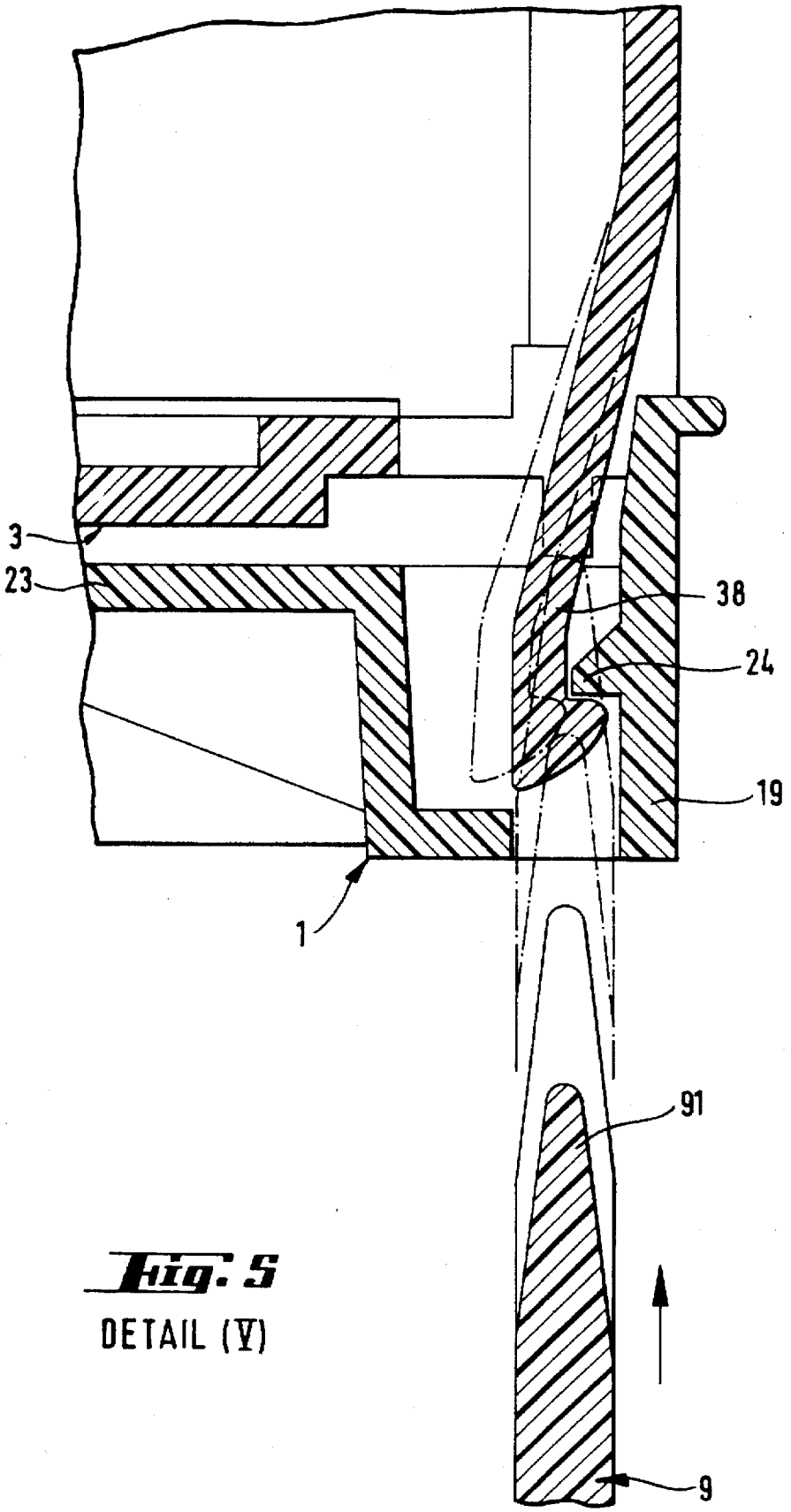
FIG. 5 displays the lock means by which the rack unit is locked on said base member.

FIG. 5 provides a detailed view of the lock at the front end of the display unit. A pawl (38), which projects downward from the rack unit (3), engages a protrusion (24) disposed at the inner front surface (19) of said base member (1).

The pawl (38) has access to the protrusion (24) through the hole (16) in base plate (23) of said base member (1).

The pawl (38) is shaped in such a way that it automatically engages protrusion (24), when the display unit (3) is mounted on base member (1).

If the key (9) is pushed upward against the lock mechanism, releasing finger (91) forces pawl (38) backward, thereby releasing the rack unit (3) from base member (1).

When the releasing finger (91) has opened the lock by forcing pawl (38) backward, pushing finger (92) lifts the front end of the rack unit (3) out of the base member (1). The guiding fingers (93) slide along the inner surfaces of the side walls (12) of said base member (1) thereby providing proper alignment of the key (9).

Figure 6:
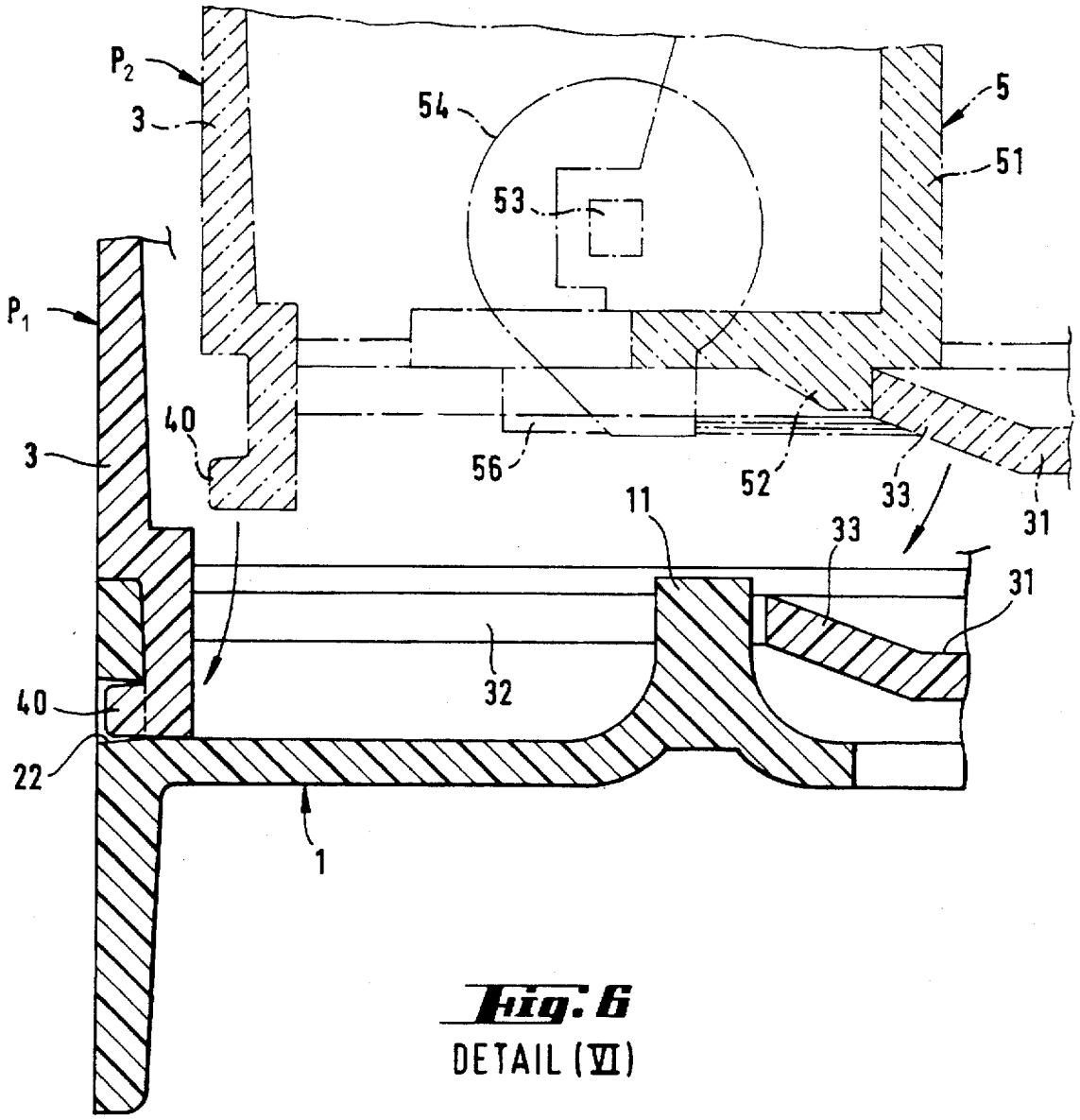
FIG. 6 displays a detailed view of the lock means, which arrests the slide member in a rear position.
Figure 7:
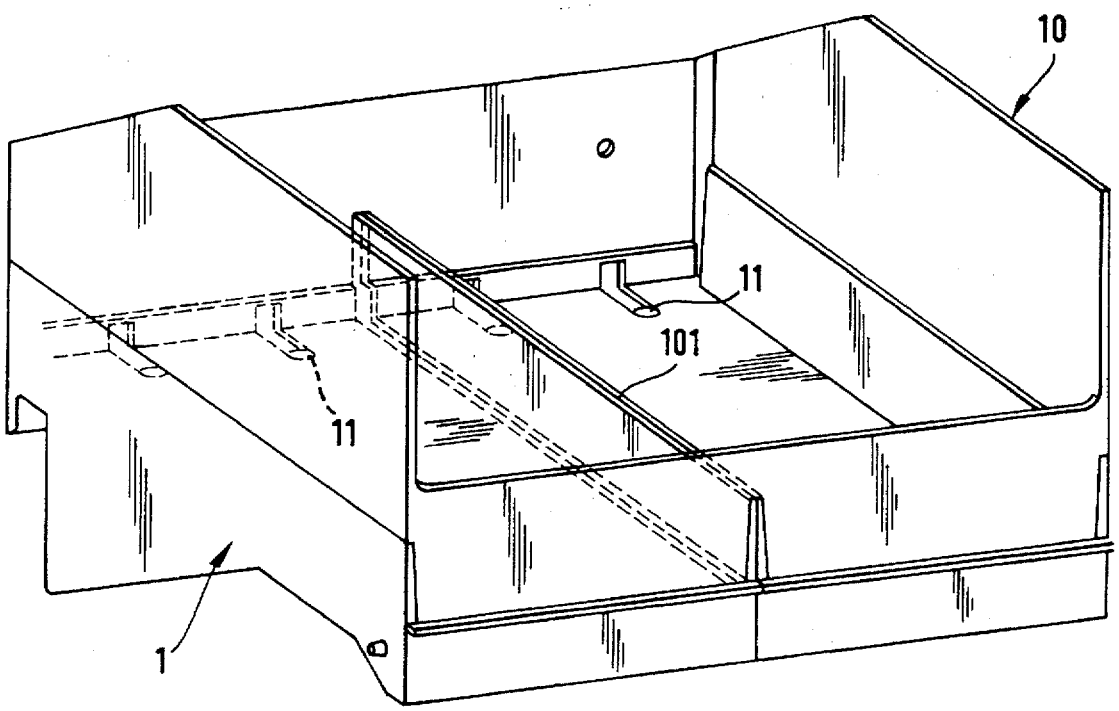
FIG. 7 shows the tray alternately mounted on the base member, instead of the rack unit.

FIG. 6 shows a detailed view of the lock mechanism at the rear end of the display unit, to lock the slide member (5) in a rear position while the rack unit (3) is (re-)filled with goods (while the rack unit (3) is removed from said base member (1)) and to automatically release said slide member (5) when said rack unit (3) is mounted on said base member (1) again. When the rack unit (3) is mounted on said base member (3), i.e. position P1, the slit (32) is occupied by the projection (11), which is rising above the base plate (22) of said base member (1). However, when the rack unit (3) is removed from the base member (1), i.e. position P2, said projection (11) no longer occupies the slit (32). In this configuration it is possible, to pull slide member (5) backward to the rear end of the rack unit (3), whereby said downward projection (52) first glides along the groove (31) and then moves across the barrier (33) at the end of said groove (31) by gliding up the gentle slope on the front side of said barrier (33). Thereafter, the downward projection (52) is trapped behind the barrier (33) in the slit (32), because the rear surface of said barrier is too steep to allow said downward projection (52) to glide up said rear surface. When the slide member (5) is locked in the rear position by means of the mechanism described above, it is easy to (re-)fill the rack unit with goods, since the slide member (5) is not interfering. Once the rack unit (3) is mounted on the base member again, the projection (11) forces the downward projection (52) out of said slit (32) thereby lifting said projection (52) across barrier (33). The slide member is released by that mechanism and is pulled forward again by spring (54), thereby pushing against the rear end of said stack of goods (G) with its front plate (51).

According to another embodiment of the invention, the slide member (5) is mounted on a separate track (55), wherein the loose end of said spring (54) is secured to the front end of said track (55). The complete assembly of slide member (5) and track (55) is then releasably mounted on the bottom of said rack unit (3).

According to another aspect of the invention a tray (10) is provided, which can be alternately mounted on a number of said base members (1) instead of said rack unit (3). The tray is provided with at least one groove (101), said groove engaging with adjacent side walls (12) of adjacent base members (1), thereby securing said tray on top of said base members. The tray (10) is provided to display other types of goods, which are not compatible with the rack units (3), without removing the complete setup of the display unit, thereby saving labor costs and other resources, as well as increasing flexiblity.

What is claimed is:

1. A display unit for displaying goods comprising:

a base member;

a rack unit for holding goods, said rack unit being capable of accommodating said goods in a stack, said rack unit having a front wall and at least two side walls and being releasably mountable on said base member;

a slide member connected to said rack unit for pushing a stack of goods forward towards the front of said rack unit, the stacking direction of said goods being parallel with the direction of motion of said slide member;

first lock means for locking said slide member in a backward position, said first lock means being automatically disengaged, by mounting said rack unit on said base member, thereby allowing the slide member to move forward thereby exerting a force in the forward direction on the rear end of a stack of goods;

a theft protection member, said theft protection member being releasably mountable on said rack unit, thereby limiting access to goods in said rack unit;

a second lock means for locking said rack unit on said base member, said second lock means being automatically engagable by mounting said rack unit on said base member, said second lock means being disengaged by a key; and means to adjust the height of the different levels of said theft protection member to accommodate different sizes of goods, said theft protection member being lockable at one of at least two predetermined height levels, by mounting said rack unit on said base member.

2. The display unit according to claim 4, said theft protection member comprising a top portion and two side portions, said theft protection member being positioned across the top of said rack unit.

3. A display unit according to claim 2, the side portions of said theft protection member being disposed in vertical guiding grooves on each side surface of said rack unit in such a way that said means to adjust the height of said theft protection member comprises at least two horizontal slots being vertically aligned in each side portion of said theft protection member, wherein said slots are disposed to engage a pair of projections, thereby fixing the height of said theft protection member, said projections being disposed in said guiding grooves on each side surfaces of said rack unit, the height of said theft protection member being adjustable, when said rack unit is removed from said base member, by slightly bending apart said side portions of said theft protection member thereby disengaging said grooves from said projections, and the height of said theft protection member being fixed by when said rack unit is mounted on said base member, wherein constraints, disposed on said base member, prevent said side portions of said theft protection members from being bent apart.

4. A display unit according to claim 1 further comprising a spring to actuate said slide member.

5. A display unit according to claim 1, wherein said slide member is biased by a spiral spring.

6. A display unit according to claim 1, wherein said slide member is mounted on a track, said track being mounted in said rack unit.

7. A display unit according to claim 4, wherein said base member comprises means to mount said base member on supporting equipment, especially shelves.

8. A display unit according to claim 7, said means to mount said base member comprising a groove or hooks in its rear end portion, thereby allowing to mount said base member on a rectangular bar.

9. A display unit according to claim 8, said base member comprising side walls, said side walls having an upper portion and a lower portion, said upper portion having rectangular shape and extending over the full length of said base member, and said lower portion of said side walls increasing in area towards the rear end thereof, said rear end of said side wall being one boundary of said groove, said rear end of said boundary abutting against said rectangular bar, thereby providing support to said base member when said base member is mounted on said rectangular bar.

10. A display unit according to claim 1, wherein said second lock means comprises a number of pairwise interacting protrusions and pawls, said interacting protrusions and pawls automatically engaging, when said rack unit is mounted on said base member, and that said key comprises a corresponding number of fingers to disengage said pawls from said protrusions, thereby releasing said rack unit from said base member and lifting said rack unit from said base member, when said key is pushed into said second lock means.

11. A display unit according to claim 1, said first lock means comprising at least one downward projection being disposed at the bottom of said slide member;

at least one groove extending on the bottom of said rack unit in the direction of motion of said slide member, thereby allowing said downward projection to slide in said groove;

at least one slit longitudinally extending at the rear end of each of said grooves, the slit and the guiding groove being separated by a barrier, said barrier rising moderately sloped from the bottom of said groove and having a steep drop toward said slit, thereby allowing said slide member to be pulled backward, across said barrier, wherein said downward projection glides up the sloped side of said barrier and is trapped behind that barrier thereafter, thereby preventing said slide member from moving forward;

said base member comprising at least one upward projection corresponding to said at least one slit, said upward projection being disposed to force said downward projection out of said slit, when said rack unit is mounted on said base member, thereby releasing said slide member.

12. A display unit according to claim 1, wherein the front wall of said rack unit is partly cut away to provide easy access to the goods in said rack unit.

13. A display unit according to claim 1, wherein the side walls of said rack unit are lower in the rear end portion than in the front end portion of said rack unit, thereby allowing easier refilling of said rack units with goods.

14. A display unit according to claim 1, wherein said rack unit and said theft protection member are made at least in part of transparent plastics.

15. A display unit according to claim 1, wherein said base member comprises a pin on one side wall and a hole on the other side wall, said pin and hole capable of engaging their respective counterpart, of an adjacent base member, if two or more base members are placed in adjacent positions.

* * * * *